US005531827A

United States Patent [19]

Trest

[11] Patent Number: 5,531,827

[45] Date of Patent: Jul. 2, 1996

[54] COATING APPARATUS HAVING A STAGNATION PREVENTION DEVICE

[75] Inventor: Jeffrey A. Trest, Rochester, N.Y.

[73] Assignee: Eastman Kodak Company, Rochester, N.Y.

[21] Appl. No.: 418,037

[22] Filed: Apr. 6, 1995

[51] Int. Cl.[6] ..... B05C 1/00

[52] U.S. Cl. ..... 118/258; 118/200; 118/244; 118/263

[58] Field of Search ..... 118/200, 232, 118/244, 249, 258, 263, DIG. 2; 427/428

[56] References Cited

U.S. PATENT DOCUMENTS

| | | | |
|---|---|---|---|
| 2,289,798 | 7/1942 | Nadeau et al. | 118/258 |
| 2,465,941 | 3/1949 | Steen | 118/258 |
| 2,775,954 | 1/1957 | White et al. | 118/258 |
| 3,648,322 | 3/1972 | Meisner | 118/258 |
| 3,828,724 | 8/1974 | Korodi | 118/258 |
| 5,117,767 | 6/1992 | Sommer | 118/126 |

*Primary Examiner*—Laura Edwards
*Attorney, Agent, or Firm*—Carl F. Ruoff; Mark G. Bocchetti

[57] ABSTRACT

The present invention is a device which is inserted into a two roll coating apparatus. The device includes two elongated bars with an arcuate surface running the length of the application roller and spaced therefrom. The bars are attached to the cross pieces on each end and fill in the area between the end of the roll and the end of the open hopper. The device eliminates turbulent eddies that occur in an open mouth hopper and thereby reduces coating defects.

2 Claims, 3 Drawing Sheets

COATING APPARATUS HAVING A STAGNATION PREVENTION DEVICE

FIELD OF THE INVENTION

The present invention relates to a coating apparatus wherein the coating solution is fed to the coating point by an application roller rotatably mounted in a hopper and partially submerged in a coating solution. More particularly, the present invention reduces turbulence around the application roller as it picks up the coating solution.

BACKGROUND OF THE INVENTION

Various roller coating methods and apparatus exist to apply solutions to moving flexible webs. One such method includes a two-roll coating process where an application roller is partially immersed and rotated in a hopper containing coating solution. A portion of the application roller rising out of the hopper containing coating solution is brought into controlled close contact with a substrate which is wrapped around another roller placed above the application roller. The space between the application roller and the substrate is typically between 0.003 inches and 0.015 inches. A bead of coating solution is formed in this space or gap, a portion of which is deposited on the moving substrate. The remainder of the coating solution remains on the roll as a thin liquid coating. The coating solution is supplied to the hopper through an inlet and the level of the solution in the hopper is controlled by a suitable control device.

Flow visualization studies have shown that the solution in the hopper stagnates due to turbulent eddy currents set up in the hopper by a combination of the rotating application roller and the flow of coating solution into the hopper. As a result of this stagnation, particulates that enter the hopper remain in the hopper and are sporadically deposited on the moving web causing unacceptable defects and waste. Particulates can enter the hopper through various vectors. These studies also show that when the solution is drained from the opposite end of the hopper, the eddy currents do not change, particulates are not purged and the flow is stratified with the particles remaining at the liquid/application roller interface continuing to generate coating defects.

Thus, there exists a need to reduce these turbulent eddies within the liquid coating hopper. The present invention minimizes eddies within a hopper containing coating solution and an application roller thereby improving coating quality and minimizing waste.

SUMMARY OF THE INVENTION

The present invention is a coating apparatus which includes an open mouth hopper which has a first end and a second end. The hopper contains a coating solution and includes an inlet for supplying the coating solution. An application roller which has a first and a second end and also has a length is rotatably mounted in the hopper with a portion of the outer surface of the roller dipping into the coating solution. A means for rotating the roller is provided. The stagnation device is immersed in the open mouth hopper and includes a first elongated bar extending the length of the roller, the first bar having an arcuate surface spaced a distance from the outer surface of the application roller. A second elongated bar extending the length of the roller and having an arcuate surface spaced a second distance from the outer surface of the roller is provided. A first cross piece connects a first end of the first hopper bar and the first end of the second hopper bar and the first cross piece extends between the end of the hopper and the first end of the roller. A second cross piece connects the second end of the first bar and the second end of the second bar and the second cross piece extends between the second end of the hopper and the second end of the roller. This stagnation prevention device reduces turbulence around the application roller.

For a better understanding of the present invention together with other objects, advantages, and capabilities thereof, reference is made to the following description and appended claims in connection with the above-described drawings.

DESCRIPTION OF THE PREFERRED EMBODIMENTS

Figure 1:
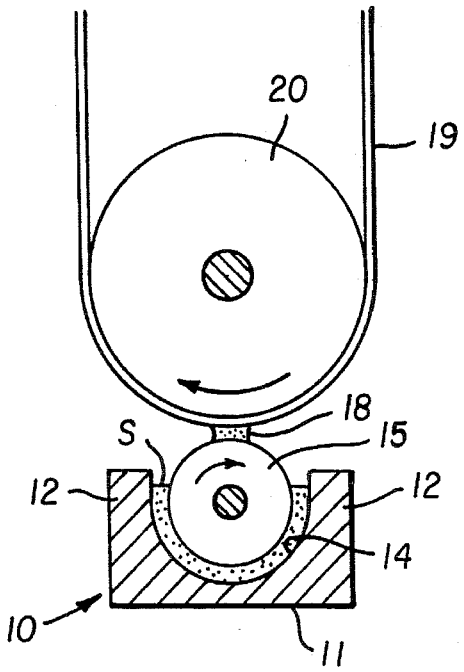
FIG. 1 shows a schematic of a prior art coating apparatus.
Figure 2:
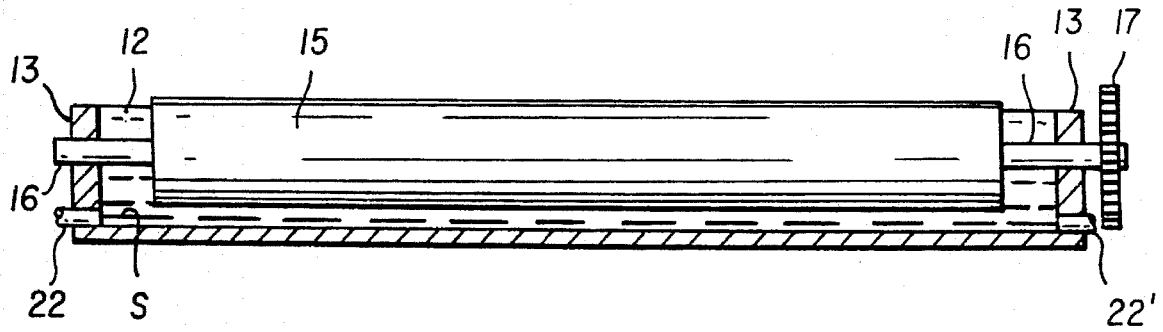
FIG. 2 is a sectional view of a prior art coating device.

Shown in FIGS. 1 and 2 is a two roll coating apparatus which includes an open mouth hopper or pan 10 having an elongated trough with a flat base 11, end walls 13 and side walls 12 adjoined by a bottom wall 14 which along with the end walls forms a reservoir or a supply of liquid coating solution S. An application roller 15 is rotatably mounted in the hopper by a shaft 16 suitably journaled in the end walls of the hopper. The bottom portion of the application roller is immersed in the coating solution S and the top portion extends through the open mouth of the hopper. When the roll is rotated in the direction of the arrow by any suitable means including gear 17 at the end of shaft 16, a layer of coating solution S is transferred from the hopper to a bead 18 that is contacted by and coats the web 19 moved and supported by roller 20 which moves in a direction opposite to that of the application roller. In some situations, it is preferable to rotate the application roller in the direction opposite shown by the arrow. Coating solution is supplied to the hopper 10 through conduit 22. Suitable control means control the level of coating solution in the hopper, such as through conduit 22' and a control valve (not shown). As is well known in the art, instead of the application roller transferring the coating solution to a bead 18 across which the web is moved thereby coating the web, the application roller may transfer the coating solution directly to the web surface or to another roller which in turn transfers the coating solution to the web directly or indirectly.

Figure 3:
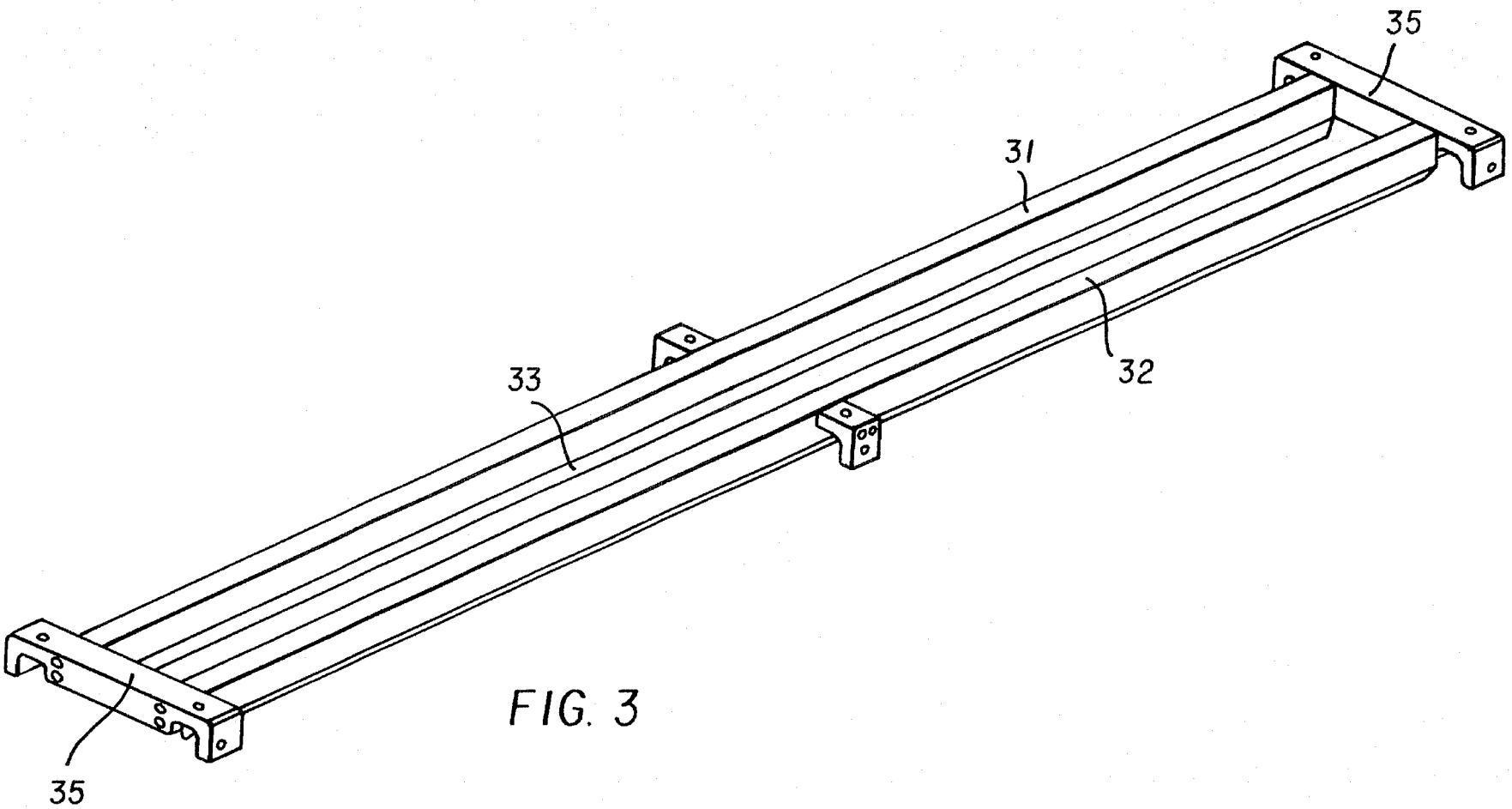
FIG. 3 is a view of the stagnation prevention device of the present invention.

The present invention is a device which is inserted into the two roll coating apparatus discussed above. The device shown in FIG. 3 includes two elongated bars 31, 32 with an arcuate surface indicated generally as 33 running the entire length of the bar. The bars are attached with cross pieces 35 on each end to fill in the area between the end of the application roller and the ends of the open mouth hopper. The cross pieces also act as brackets for mounting the device on the two roll coating apparatus. The arcuate surfaces 33 of the bars 31, 32 are spaced between 0.04 inches and 0.06 inches away from the application roller surface. The arcuate surfaces of the bars are immersed in the coating solution, thus eliminating the air-liquid interface. The tight gap created around the application roller reduces the Reynolds number at the interface from a turbulent glow situation of 3,000 to 5,000 to one of laminar flow at 300 to 500. This ten fold reduction in Reynolds number eliminates turbulent eddies and currents and particles and debris can be flushed out of the open mouth hopper. An additional benefit of the device is that evaporation is prevented and there is no place for environmentally deposited dirt to collect.

Figure 4:
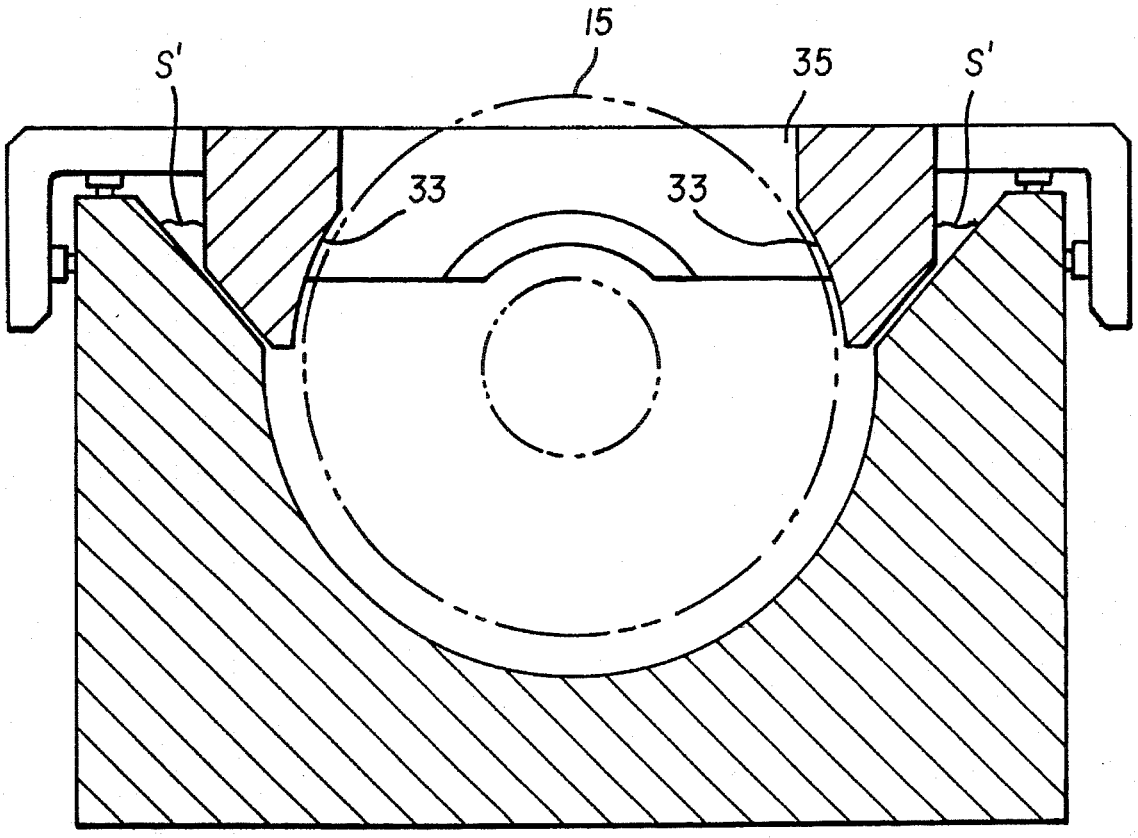
FIG. 4 shows a coating apparatus which includes stagnation prevention device of the present invention.

FIG. 4 shows a cross sectional view of the stagnation prevention device of the present invention inserted in the two roll coating apparatus. As shown, the stagnation prevention device is not submerged in the coating liquid. The coating liquid level is shown generally by S'. Rather, the arcuate surfaces 33 which closely match the curvature of the application roller 15 are partially immersed while the top side of the application device is not in the coating solution. This eliminates the air-liquid interface that occurs in the prior art device. The stagnation prevention device mounts to the hopper by the cross piece 35. The web and support roller are not shown in FIG. 4.

The present invention has been tested in production coatings and has been found to eliminate production waste problems, mainly gel nitrate specs which form in the coating solution. Quantitative data is not easily collected, although the use of this device has eliminated many waste problems due to coating defects.

While there has been shown and described what are at present considered to be the preferred embodiments of the present invention, it will be apparent to those skilled in the art that various modifications and alternations may be made herein. All such modifications and alterations are considered to be within the scope of the following claims.

What is claimed is:

1. A coating apparatus comprising:

an open mouth hopper having a first end and a second end containing a coating solution, said hopper having an inlet for supplying coating solution and an outlet for withdrawing coating solution;

an application roller having a first end and a second end and having a length, said application roller rotatably mounted in said hopper having a portion of an outer surface dipping into the coating solution;

means connected to the roller for rotating the roller;

a stagnation prevention device immersed in said open mouth hopper comprising;

a first elongated bar extending the length of said roller, the first bar having an arcuate surface spaced a first distance from the outer surface of said application roller;

a second elongated bar extending the length of said roller, the second bar having an arcuate surface spaced a second distance from the outer surface of said application roller, said first and second distances being from about 0.040 inches to about 0.060 inches thereby creating a tight gap between said first and second elongated bars and the roller such that a laminar flow condition is produced in the coating solution;

a first cross piece connected to a first end of the first bar and a first end of the second bar, the first cross piece extending between the first end of said hopper and the first end of said roller; and a second cross piece connected to a second end of the first bar and a second end of the second bar, the second cross piece extending between the second end of said hopper and the second end of said roller wherein said stagnation prevention device reduces turbulence around said application roller, said first and second elongated bars, said roller, and said first and second cross pieces substantially covering the surface of the coating solution such that evaporation is substantially prevented.

2. The coating apparatus according to claim 1 wherein the first bar, the second bar, the first cross piece and the second cross piece are integral.

* * * * *